United States Patent [19]

Sweers

[11] Patent Number: 4,713,915

[45] Date of Patent: Dec. 22, 1987

[54] EDGE CLIP FOR AN EAVES TROUGH MOUNTING ADAPTER

[76] Inventor: Ronald L. Sweers, 6165 E. Atherton Rd., Burton, Mich. 48519

[21] Appl. No.: 867,899

[22] Filed: May 20, 1986

Related U.S. Application Data

[63] Continuation of Ser. No. 644,818, Aug. 27, 1984, abandoned.

[51] Int. Cl.[4] ..... E04D 13/06

[52] U.S. Cl. ..... 52/11

[58] Field of Search ..... 52/11, 72; 248/48.1, 248/48.2

[56] References Cited

U.S. PATENT DOCUMENTS

| | | | |
|---|---|---|---|
| 2,801,601 | 8/1957 | Riedel | 52/11 |
| 3,913,284 | 10/1975 | Hall | 52/11 |
| 4,257,716 | 3/1981 | Woodrow | 52/11 X |
| 4,271,643 | 6/1981 | Sweers | 52/11 |
| 4,300,319 | 11/1981 | Frost et al. | 52/11 |
| 4,305,236 | 12/1981 | Williams | 52/11 |

*Primary Examiner*—Stuart S. Levy
*Assistant Examiner*—Lynn M. Sohacki
*Attorney, Agent, or Firm*—Gifford, Groh, VanOphem, Sheridan, Sprinkle and Dolgorukov

[57] ABSTRACT

A clip is provided for use in conjunction with an eaves trough adapter of the type having a roof flange which flatly abuts against and protrudes outwardly from the upper surface of the roof and a drip flange which extends from the outer edge of the roof flange and towards the building eave. Such eaves trough adapters are typically secured to the building in an end to end alignment with each other. The clip includes a first flat portion which flatly abuts against and overlies the intersection of two adjacent roof flanges. A second clip portion overlies and flatly abuts against the intersection of the drip flange to both strengthen the eave trough adapters as well as provide an even roof line at their intersection.

3 Claims, 2 Drawing Figures

EDGE CLIP FOR AN EAVES TROUGH MOUNTING ADAPTER

This is a continuation of co-pending application Ser. No. 644,818 filed on Aug. 27, 1984 now abandoned.

BACKGROUND OF THE INVENTION

I. Field of the Invention

The present invention relates to an edge clip for an eaves trough adapter secured to a building.

II. Description of the Prior Art

There are a number of previously known eaves trough adapter strips such as shown in U.S. Pat. No. 4,271,643 which issued on Jun. 9, 1981 to Ronald L. Sweers. This previously known adapter strip comprises a flat roof flange which abuts against and protrudes outwardly from the edge of the roof. A drip flange then extends inwardly towards the building from the outermost edge of the roof flange while a downwardly facing channel portion depends from the innermost edge of the drip flange. A top edge of a rain gutter is then positioned within the channel and secured to the building eave by conventional fasteners, such as nails. Such adapter strips are conventionally constructed in predetermined lengths, i.e. ten foot long sections, and/or secured to the building eave in end to end alignment with each other.

Since the eaves trough adapter strip is typically constructed from sheet metal, the intersection of two adjacent adapter strips are usually not perfectly aligned with each other. This condition not only presents an uneven roof line at the intersection between two adapter strips but also permits leakage between the intersection of the adapter strips.

SUMMARY OF THE PRESENT INVENTION

The present invention provides an edge clip which overcomes the above mentioned disadvantages of the previously known eaves trough adapter strips.

In brief, the edge clip of the present invention comprises a first flat portion which is adapted to flatly abut against and overlie the intersection of the roof flanges on two adjacent adapter strips. A second flat portion extends from the outermost edge of the first portion and towards the building eave. This second portion flatly abuts against and overlies the intersection of two drip flanges and also preferably includes a downwardly depending portion which abuts against the adapter strip channel portion. Consequently, the clip conforms to the shape of the adapter strip.

The edge clip not only covers the intersection of two adjacent adapter strips in order to minimize leakage at the intersection but also forces the adapter strips into alignment with each other to provide an even roof line.

BRIEF DESCRIPTION OF THE DRAWING

A better understanding of the present invention will be had upon reference to the following detailed description when read in conjunction with the accompanying drawing, wherein like reference characters refer to like parts throughout the several views and which.

DETAILED DESCRIPTION OF THE PREFERRRED EMBODIMENT OF THE INVENTION

Figure 2:
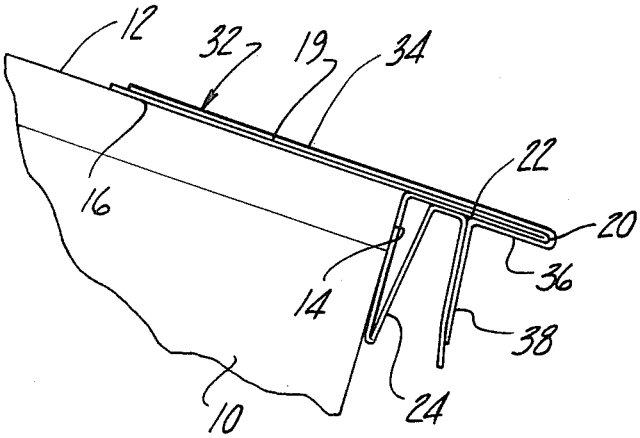
FIG. 2 is an end view illustrating the preferred embodiment of the present invention.

With reference to the drawing, a portion of a building 10 is thereshown having a roof 12 and a building eave 14. As best shown in FIG. 2, the roof 12 is formed at an angle so that water normally flows downwardly along the roof 12 and toward the eave 14.

Figure 1:
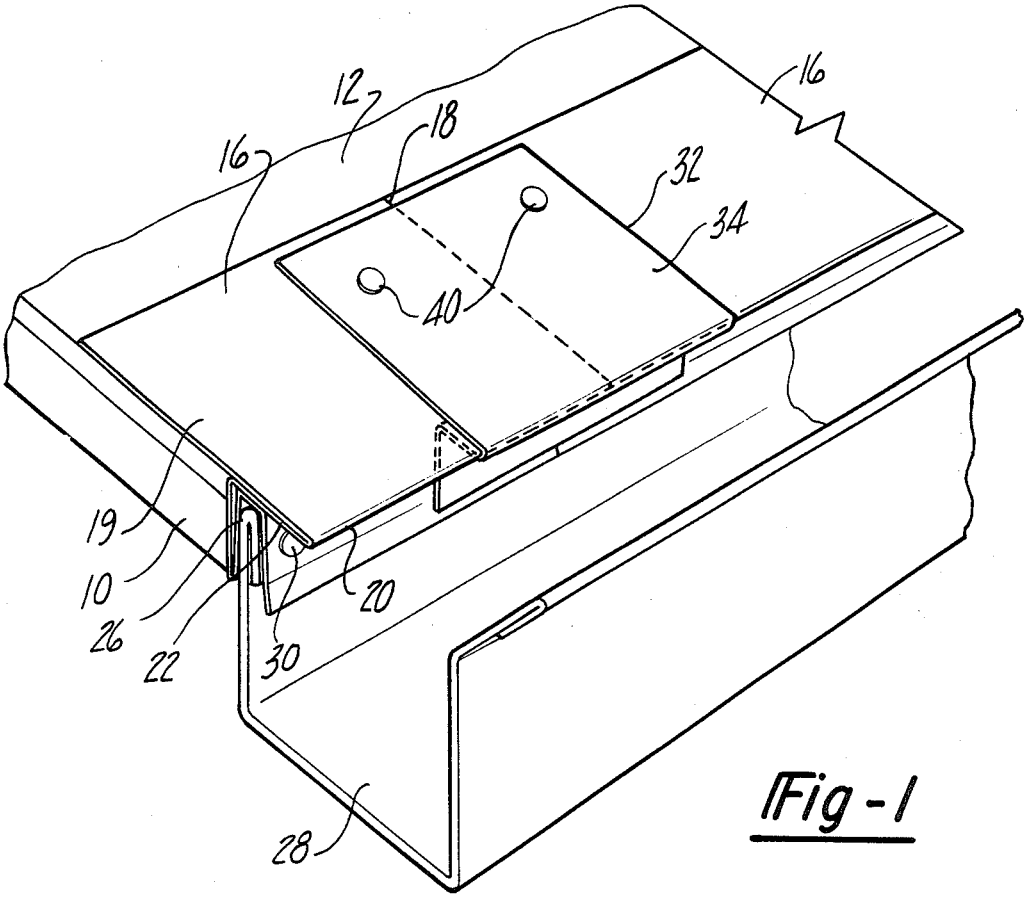
FIG. 1 is a fragmentary perspective view illustrating a preferred embodiment of the present invention.

A pair of eaves trough adapter strips 16 are secured to the roof 12 in end to end alignment with each other thus forming an intersection 18 therebetween. Although the adapter strip 16 may be of any conventional construction, as illustrated in the drawing, each adapter strip 16 comprises an elongated and flat roof flange 19 which flatly abuts against the top of the roof 12 so that one edge 20 of the roof flange 19 protrudes outwardly from and is parallel with the building eave 14. An inwardly extending drip flange 22 extends inwardly from the outer edge 20 of the roof flange 19 and toward the building eave 14 while a downwardly extending channel portion 24 depends downwardly from the inner edge of the drip flange 22. One side 26 (FIG. 1) of a U-shaped rain gutter 28 is then positioned within the channel portion 24 and secured to the roof 12 by conventional fasteners 30.

The adapter strips 16 are conventionally constructed from one piece sheet metal which is bent to form the drip flange 22 and channel portion 24. Consequently, at their intersection 18 the adapter strips 16 are usually not coplanar with each other.

The present invention, however, provides an edge clip 32 having a flat first portion 34 which is positioned over the intersection 18 and two adapter strips 16 and flatly abuts against the roof flange 19 of both these adapter strips 16.

As best shown in FIG. 2, the edge clip 32 extends around the outer most edge 20 of the adapter strips 16 and includes an inwardly extending second portion 36. This second portion 36 overlies the intersection of the drip flanges 22 on the two adapter strips 16 while a further downwardly extending portion 38 flatly abuts against and overlies the intersection of the outer most side of the channel portions 24 of the adjacent adapter strips 16. With the edge clip 32 positioned as described above, it is secured to the roof 12 in any conventional fashion, such as by fasteners 40..

In the preferred form of the invention, the entire edge clip 32 is preferably constructed from a single piece of sheet metal and bent to conform to the shape of the adapter strips 16 in the fashion described above.

With the edge clip 32 secured to the roof 12 and to the intersection 18 of two adapter strips 16, the edge clip 32 forces the adapter strip 16 into alignment with each other thus producing an even roof line across the intersection of the adapter strips 16. Furthermore, since the edge clip 32 covers the intersection 18 between two adapter strips 16, the edge clip 32 eliminates any water leakage which might otherwise occur between the intersection 18 of the adapter strips 16.

Having described my invention, however, many modifications thereto will become apparent to those skilled in the art to which it pertains without deviation from the spirit of the invention as defined by the scope of the appended claims.

I claim:

1. In combination:

an inward-to-outward downwardly sloping roof surface;

at least two eaves trough adapter strips of the type having: a roof flange adapted to flatly abut against and overlie said roof surface, said roof flange including an outer flange edge disposed outward of said roof surface; a drip flange extending slantingly upwardly from said outer flange edge parallel to and towards said roof surface; and a gutter-receiving portion extending downwardly from said drip flange;

a clip for securing said adapter strips on said roof surface in end-to-end abutment with one another, said clip comprising: a first inward-to-outward downwardly sloping flat portion adapted to flatly abut against and overlie the locus of abutment of the roof flanges of said two adapter strips, said first portion being disposed parallel to said roof surface, and including an outer clip edge outward of said roof surface; a second outward-to-inward upwardly sloping plate portion extending parallel to said roof surface and to said first flat portion and extending from said outer edge of said first flat portion and towards said roof surface, said second portion adapted to overlie and flatly abut against the locus of abutment of the drip flanges of said two adapter strips, and including an inner edge outward of said roof surface and inward of said outer clip edge; and a third flat portion extending downwardly from said inner edge of said second portion, said third portion adapted to overlie and flatly abut against the locus of abutment of said gutter-securing portions of said two adapter strips; and means for securing said clip to said roof surface and said two adapter strips;

wherein said clip closely conforms in shape to the flange portions of said eaves trough adapter strips for both simultaneously aligning said abutted adapter strips and for sealing the locus of abutment of said adapter strips against leakage, and wherein the width of said clip is at most equal to the width of said roof flange along said downwardly sloping roof surface.

2. The invention as defined in claim 1 wherein said clip is constructed of sheet metal.

3. The invention as defined in claim 2 wherein said clip is of a one piece construction.

* * * * *